US007559858B2

(12) United States Patent
Hallock

(10) Patent No.: US 7,559,858 B2
(45) Date of Patent: Jul. 14, 2009

(54) APPARATUS AND METHOD FOR INDICATING A GOLF BALL'S POSITION ON THE FIELD OF PLAY

(76) Inventor: Joseph A. Hallock, 600 Valley Rd., Wayne, NJ (US) 07470-3535

( * ) Notice: Subject to any disclaimer, the term of this patent is extended or adjusted under 35 U.S.C. 154(b) by 304 days.

(21) Appl. No.: 10/535,999

(22) PCT Filed: Nov. 26, 2002

(86) PCT No.: PCT/US02/37837

§ 371 (c)(1),
(2), (4) Date: May 24, 2005

(87) PCT Pub. No.: WO2004/047935

PCT Pub. Date: Jun. 10, 2004

(65) Prior Publication Data

US 2006/0058121 A1 Mar. 16, 2006

(51) Int. Cl.
*A63B 57/00* (2006.01)

(52) U.S. Cl. ..... 473/406

(58) Field of Classification Search ..... 473/406, 473/575, 576, 594; 446/46, 48; 116/173, 116/174, 222

See application file for complete search history.

(56) References Cited

U.S. PATENT DOCUMENTS

| | | | | | |
|---|---|---|---|---|---|
| 2,663,024 | A | * | 12/1953 | Cantor | 2/175.5 |
| 4,115,946 | A | * | 9/1978 | Vukmirovich | 473/588 |
| D299,904 | S | * | 2/1989 | Smith | D7/393 |
| 4,912,800 | A | * | 4/1990 | Zeltner | 15/114 |
| D317,191 | S | * | 5/1991 | Williams et al. | D21/788 |
| 5,706,756 | A | * | 1/1998 | Cunningham et al. | 116/173 |
| D427,046 | S | * | 6/2000 | Mannix | D8/322 |
| D455,935 | S | * | 4/2002 | Detiveaux | D7/624.2 |
| 6,383,095 | B1 | * | 5/2002 | Azotea | 473/406 |
| D520,095 | S | * | 5/2006 | Wright | D21/789 |

* cited by examiner

*Primary Examiner*—Steven Wong
(74) *Attorney, Agent, or Firm*—W. Patrick Quast, Esq.

(57) ABSTRACT

An accessory (1) to be used for indicating the location of a golf ball on the field of play, wherein a brightly-colored waterproof piece of material contains a pocket (2) holding an object of the same or similar diameter as a golf ball, this pocket being either elasticized (2*b*) at its opening or sewn closed to prevent this object from being dislodged. To prevent movement of the indicator, weighting means (4*a*) can be sewn along the indicator's outside edge (3). A hole (8*a*) can be provided for easy hanging from a key chain or elsewhere, and markings (9) can be placed on the body of the fabric. The indicator is placed as closely as possible to the played golf ball without moving it, then retrieved for later use.

12 Claims, 7 Drawing Sheets

APPARATUS AND METHOD FOR INDICATING A GOLF BALL'S POSITION ON THE FIELD OF PLAY

TECHNICAL FIELD OF THE INVENTION

This invention relates to golfing equipment, and more particularly to an inexpensive and convenient accessory, and method of use thereof, for readily indicating one's golf ball on the field of play, thereby speeding up the game and making the game more pleasurable.

BACKGROUND ART

It is acknowledged in the sport of golf that players' overcrowding of courses has become a problem to both course operators and players alike. For instance, in order to handle the increased number of players, course operators have increased the number of tee times over the day, thus shortening the duration between tee times and causing groups to tee off one after the other. Because of this increased traffic on the course, golfers are often forced to abandon a played golf ball that is not clearly visible to players, such as in the rough; this is so because although the ball is fairly within bounds, it would take an inordinate amount of time in trying to locate it. As a result, golfers often suffer not only the expense of having to replace the golf ball but also the frustration of having to add strokes to their score for a lost ball.

Even should other golfers spot where a ball landed and somehow indicate its position, the problem still exists. For example, if told roughly where his ball has landed, by the time the golfer approaches his ball, he may have lost all bearings and/or landmarks which the other golfers referred to from the tee or wherever the ball was launched. In other instances, a golfer or caddy finding a ball may have attempted to indicate the position of the ball by leaving an article of clothing or piece of equipment near the ball when passing by it. Unfortunately, however, there are numerous flaws with such actions. For instance, should the ground be wet or dirty, the article or equipment may become wet or dirty also, sometimes even damaging the equipment irreparably. Additionally, this makeshift marker may be inadvertently left behind, forcing the owner to return to look for it when, and if, he realizes it has been forgotten; if never found, the replacement cost can be quite expensive, if for example a club were left as the marker. It is easily appreciated, therefore, that all of these occurrences cause undue expense and aggravation to the golf course users and operators, who either cannot readily locate a played ball, have left some impromptu marker behind to indicate where a played ball has landed, or attempt to schedule tee times and speed of play in order to accommodate players who later on will slow play down through being unable to locate played balls easily.

A search of the prior art reveals efforts to ameliorate this problem. For instance, in U.S. Pat. No. 5,356,133 to Bellagamba, there is described a golf ball marker for use on a putting green manufactured from a flat piece of material having top and bottom sides and an edge therearound. The edge has a concave arcuate portion shaped to fit around a portion of a golf ball and also has a point generally centered on and opposite the concave arcuate edge portion and has surface markings formed on the top of the flat piece of material, generally metal, including an arcuate line spaced from and parallel to the concave arcuate edge portion and has an arrow between the center of the concave arcuate edge portion and the center of the pointer. An aperture through the ball marker is positioned in or adjacent the point formed in the edge thereof. Additionally, in U.S. Pat. No. 6,383,095 to Azotea, there is described a golf ball indicator in the nature of a stake, generally manufactured of metal, which is pressed into the ground to mark a golf ball that would otherwise be hidden by the tall grass of a golf course "rough," having a visible flag and of a length to extend above the height of the grass when inserted by pressing down on a surrounding flange positioned adjacent a bottom spike of the stake or in serving as a depth stop for the placement.

Numerous failings exist with these efforts, however. First, while each of these inventions do indicate where a played ball has landed on the course, by being made of metal and therefore unable to be folded or easily and lightly toted, these inventions can be unwieldy to carry; golfers and caddies using a full set of clubs would be loath to expend more energy on carrying such products, useful as they would be. This is even more the case where one must drive a stake in the ground, which not only is expected to be heavier than other measures but would itself be unduly time-consuming, and thereby defeating the goal of simple, efficient ball indication. In a similar vein, by being made through precision crafting, the inventions of the prior art are of not insignificant expense. Golf players, especially amateur players, would not expect to bear a greater additional cost to their equipment, and golf course operators would be unlikely to add overhead to their operations through investing in such products. Finally, by themselves being more precision-crafted than a mere article of clothing, these inventions are themselves too desirable to lose through forgetfulness; this defeats the desired purpose of having an inexpensive, simple device to indicate the position of one's golf ball on the field of play.

OBJECTS OF THE INVENTION AND INDUSTRIAL APPLICABILITY

It is an object of the present invention, therefore, to provide a new inexpensive, lightweight, portable, decorative, and efficient accessory to mark the location of a played golf ball, and its method of use, so that it can be located easily by an advancing player.

It is another object of the present invention to substantially reduce the amount of time spent by golfers searching for their ball, or having to return for equipment or clothing used to mark the location of a ball, thereby speeding up play and easing congestion on the golf course.

SUMMARY OF THE INVENTION

Consequently, to achieve these and other aims and objectives, the present invention provides for an accessory to be used for indicating the location of a played golf ball on the field of play, especially on the rough, and method of use thereof, wherein a brightly-colored piece of material, such as nylon or some other type of waterproof fabric, contains a pocket in which a standard-sized golf ball or object of similar diameter is to be fitted. In one embodiment, this pocket has an elasticized collar at its opening into which the golf ball or object is removably closely fitted. The elastic material for the collar can be either sewn into the body of the indicator or affixed externally at a discrete point on the outer surface of the indicator and looped around the ball. In another embodiment, this pocket is sewn closed to prevent this object from being lost from the indicator. Alternatively, a cylindrical object having a diameter equal or similar to that of a standard-sized golf ball is sewn into the pocket to provide for a raised surface, allowing for greater visibility at longer distances along the field of play. In any embodiment, there can be sewn into the indicator along its outside edge either a continuous weighted strip or individual weights at discrete points to prevent wind or other environmental means from moving the indicator. Any embodiment of the indicator may also have a hole placed within the body of the fabric to allow for easy hanging from a key chain or peg on a golf cart or club bag, and lettering, numerals, or graphics can be located on the top surface of the body of the fabric. The indicator is used by placing the object in the pocket down on the field of play at or as near as possible to the site where a played ball ha landed without dislodging the ball from its initial resting place upon locating this played ball, the indicator is then retrieved, ready to be used for play on the next hole.

DETAILED DESCRIPTION OF THE INVENTION

Figure 1:
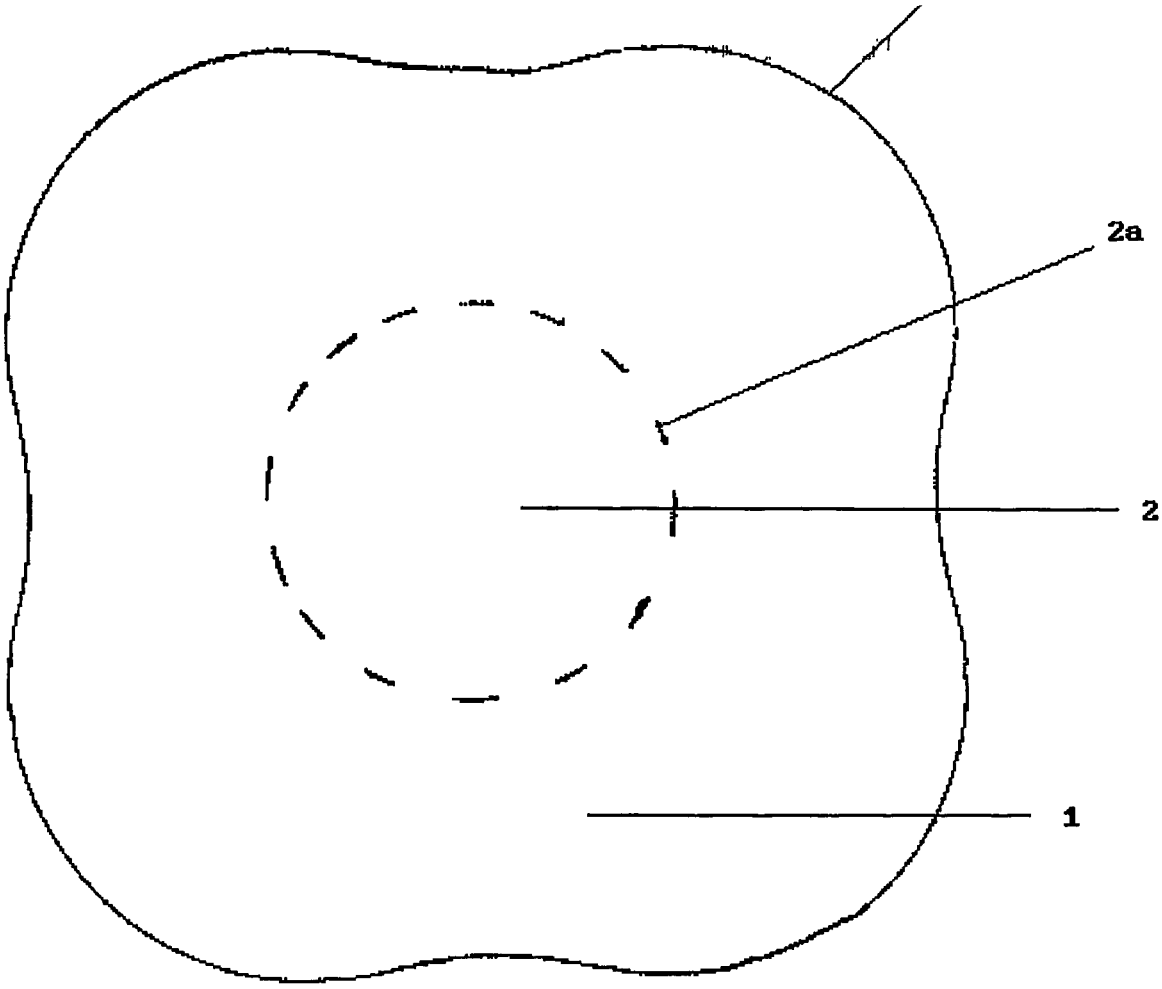
FIG. 1 shows a top view of one embodiment of the indicator.

There is depicted in FIG. 1 an apparatus to be used to indicate the position of a played golf ball on the field of play. While the indicator may be used anywhere along the field of play, a golfer would deem the present invention to be most useful to indicate a ball's position in the rough. The body 1 of the indicator is to be made from a durable, collapsible, washable, lightweight waterproof fabric, such as nylon. Preferably the body 1 is brightly-colored in a color different than those not typically found in a golf course environment, such as green, brown, or sand, in either solid or variegated patterns. The outer edge 3 of the body 1 may form any geometrical shape when viewed from above or below, such as a square or circle. To allow for maximum visibility from a distance yet minimal space taken during transportation or in storage, the area of the body 1 should occupy a space, when completely flattened out, of approximately 380 square inches. A circular pocket 2 is to be formed from the bottom surface of the body 1, either uniformly with the fabric or made from a separate piece of material. The opening of the circular pocket 2 is found on the top surface of the body 1, with a diameter sufficient enough to permit passage of a standard-sized golf ball. The center of the circular pocket 2 should be equidistant from any given point along the outer edge 3 of a circular body, else centrally positioned for any other geometrical body shape. Within this circular pocket 2 is inserted either a standard-sized golf ball or other object of similar diameter but not necessarily of similar volume or height off the surface.

Figure 2:
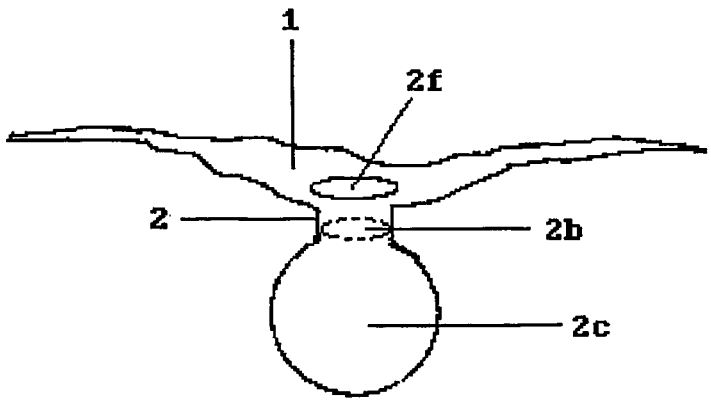
FIG. 2 shows a side view of one embodiment of the indicator having a pocket with inserted object with an elasticized collar sewn in the body.

As seen in FIG. 2, an elasticized collar 2*b* may be sewn into the body 1, at the opening 2*f* of the circular pocket 2, to permit a standard-sized golf ball 2*c*, or object of similar diameter, to be removably placed through hole 2*f* in the body 1, using nominal insertion pressure, within the circular pocket 2. The collar 2*b* allows the ball 2*c* placed within the circular pocket 2 to be easily removed for washing the indicator, or, should the need arise, replacement of the ball 2*c*, while still preventing accidental dislodging of the ball 2*c* during use on the field of play or elsewhere. Alternatively, as suggested in FIG. 1, the outer edge 2*a* of this hole 2*f* is to be sewn closed to prevent the golf ball or object within from escaping the pocket.

Figure 3:
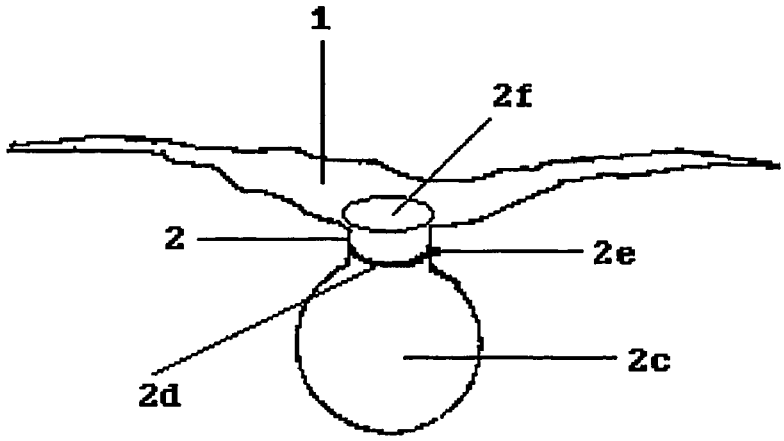
FIG. 3 shows a side view of one embodiment of the indicator having an externally-fitted elasticized collar.

Conversely, FIG. 3 depicts a pocket 2 wherein an elasticized collar 2*d* is affixed to the external surface of the body 1 at a discrete point by a fastening means 2*e*, such as a stitch or metal stud or ring, in such a way that the collar 2*d* is looped around the golf ball 2*c*, or object of similar diameter, placed within the circular pocket 2.

Figure 4:
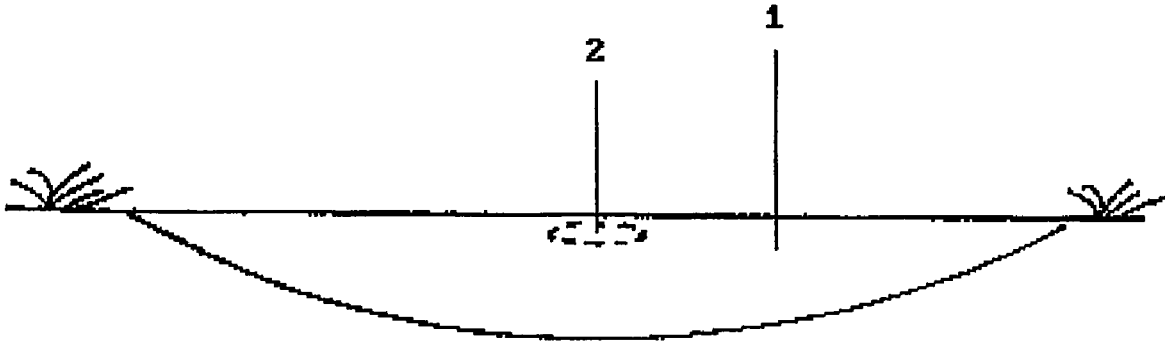
FIG. 4 shows a side view of one embodiment of the indicator placed on the field of play.

As suggested in FIG. 4, the position where the ball lands after it is struck from the tee or elsewhere may be marked using the present invention by placing the object within the circular pocket 2 as closely as possible, given where the ball lies on the surface, to the played ball without dislodging the ball from its initial resting place. The outer edge 3 of the body 1 may be smoothed out as completely as possible to prevent inadvertent movement of the indicator or played ball, thereby giving an accurate view of the ball's position on the field of play. However, at the user's discretion, the indicator may be simply dropped at the location of the played ball, thereby speeding up play even further.

Figure 5:
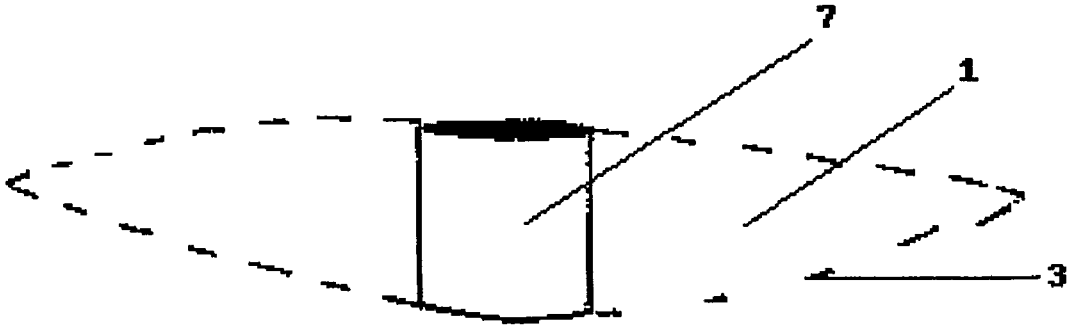
FIG. 5 shows a lateral cutaway view of another embodiment of the invention.
Figure 6:
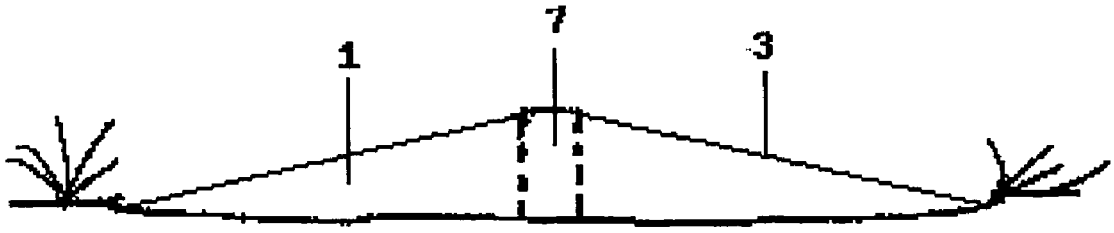
FIG. 6 shows a side view of another embodiment of the indicator, with a cylindrical ball holder, placed on the field of play.

In an alternative embodiment of the present invention, as shown in FIGS. 5 and 6, a cylindrical object 7 of the same or similar diameter as a standard-sized golf ball is placed into the circular pocket 2 of the indicator, with the outer edge 2*a* of this circular pocket 2 sewn tightly closed to prevent the cylindrical object 7 within from escaping the pocket 2. The object 7 should be made of a rigid, non-collapsible material such as plastic and, as evident from FIG. 6, of a sufficiently greater height above ground level than a standard-sized golf ball to make the top surface of the body 1 roughly appear cone-shaped. By thus giving the indicator such height, the position of the played ball should be visible over greater distances.

Figure 7:
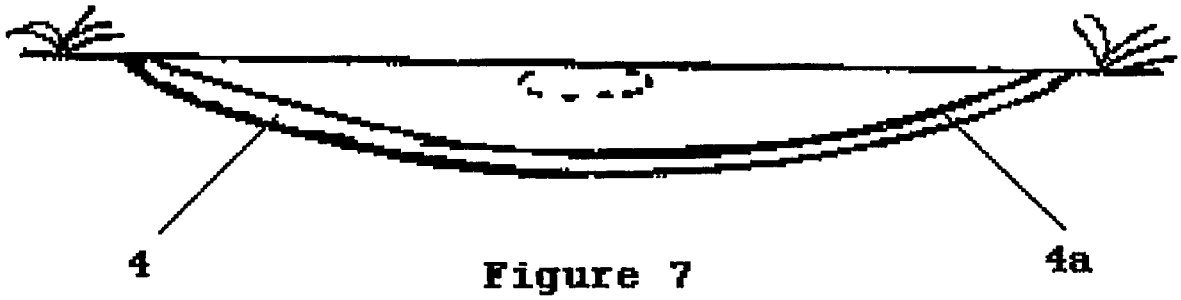
FIG. 7 shows a side view of another embodiment of the indicator, with an oversewn outer edge, placed on the field of play.
Figure 8:
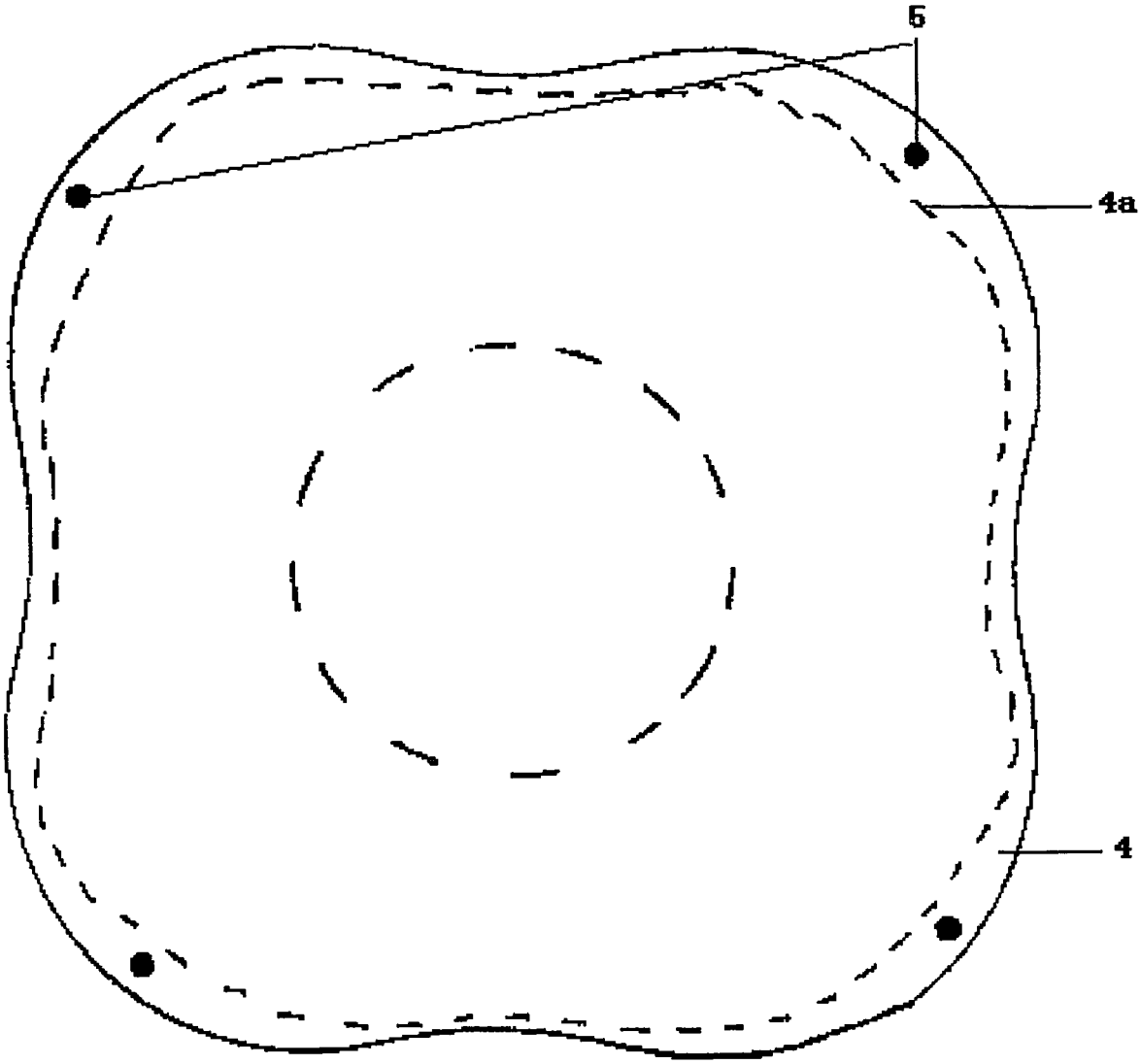
FIG. 8 shows a top view of an embodiment with equidistantly-placed weights placed along the oversewn edge.
Figure 9:
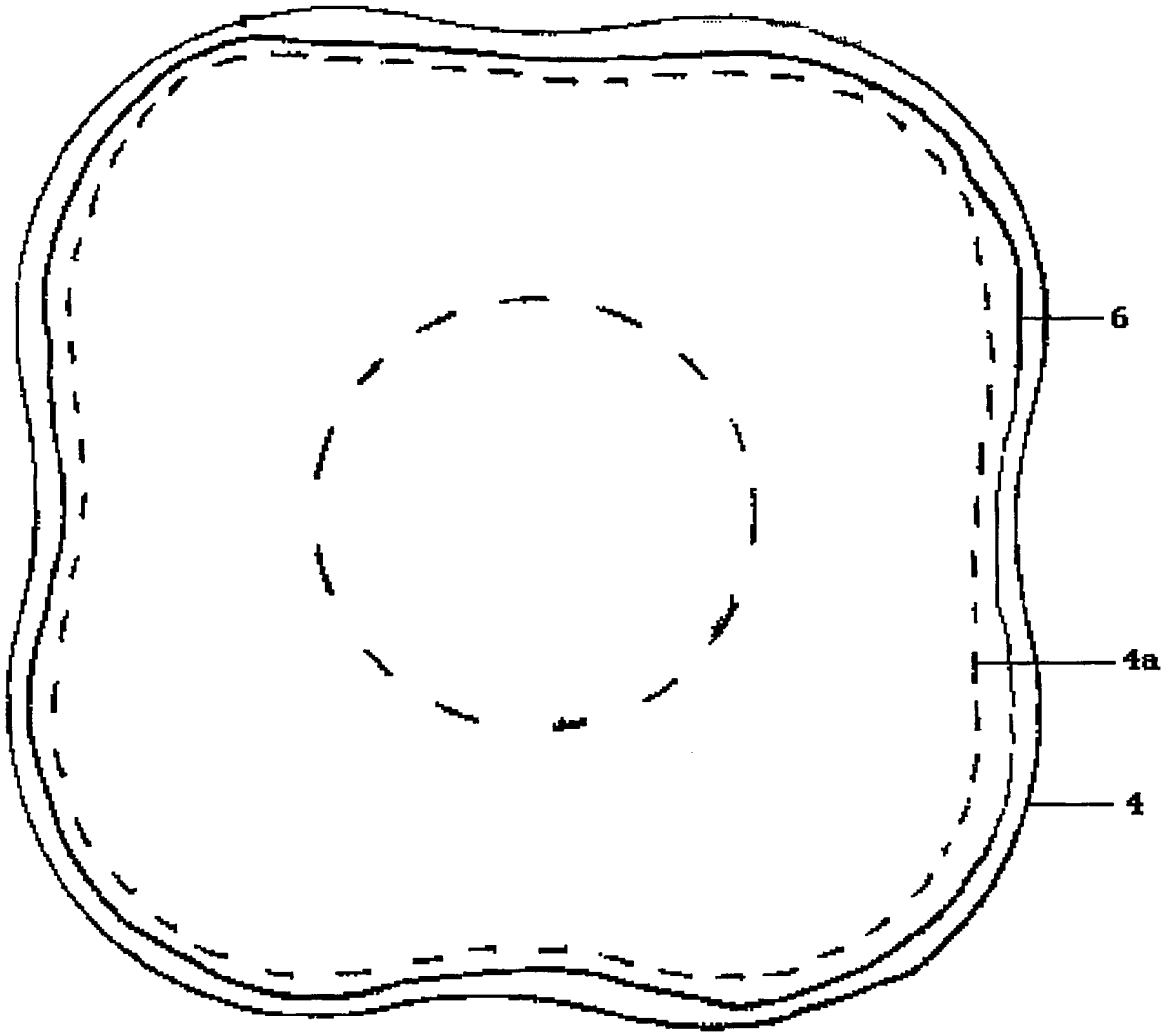
FIG. 9 shows a top view of an embodiment with a continuous weighted strip placed along the oversewn edge.

In another alternative embodiment of the present invention, as depicted in FIG. 7, the outer edge 3 of the body 1 is oversewn on the body 1 at a seam 4*a* to form a pocket 4 along the perimeter or outermost circumference of the indicator. As shown in FIGS. 8 and 9, either discrete individual weights 5, placed equidistantly or grouped together, or a weighted strip 6 which runs the entire length of the pocket 4 are to be inserted into this pocket 4, such that the seam 4*a* is tightly sewn over these weighting measures, thereby preventing their movement within the pocket 4. The weighted strip 4*a* is preferably made from a collapsible or deformable material to allow for folding or other deformation of the indicator when placed, for example, in a pants pocket or other tight space. The purpose of the weights 5 or the weighted strip 6 is to weigh down the outer edge of the body 1 of the indicator and thereby prevent the indicator from being blown away by a gust of wind which could lift up the bottom surface of the body 1, or from other environmental conditions found on the golf course such as slipping down the slope of a sand trap.

Figure 10:
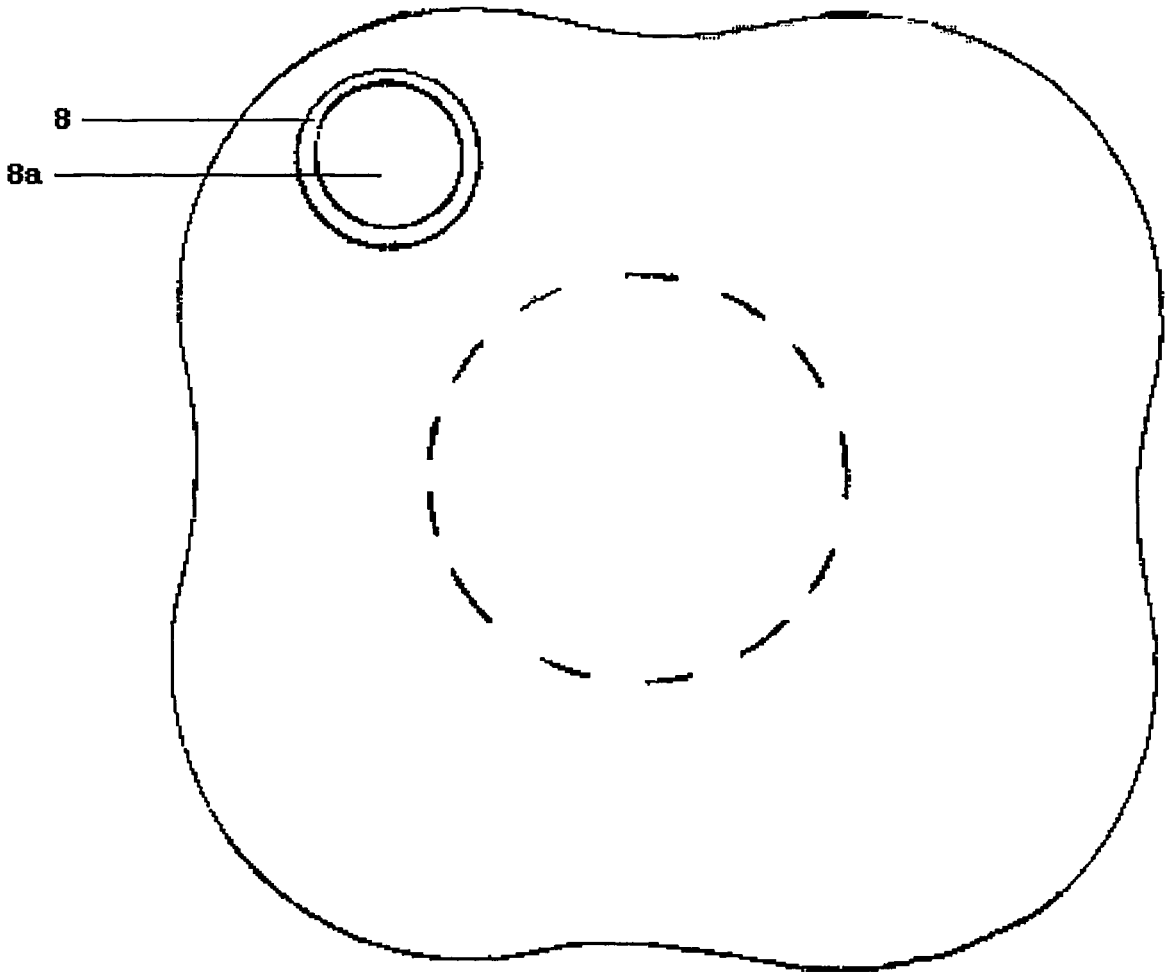
FIG. 10 shows a top view of another embodiment of the indicator, hole in the body of the indicator.
Figure 11:
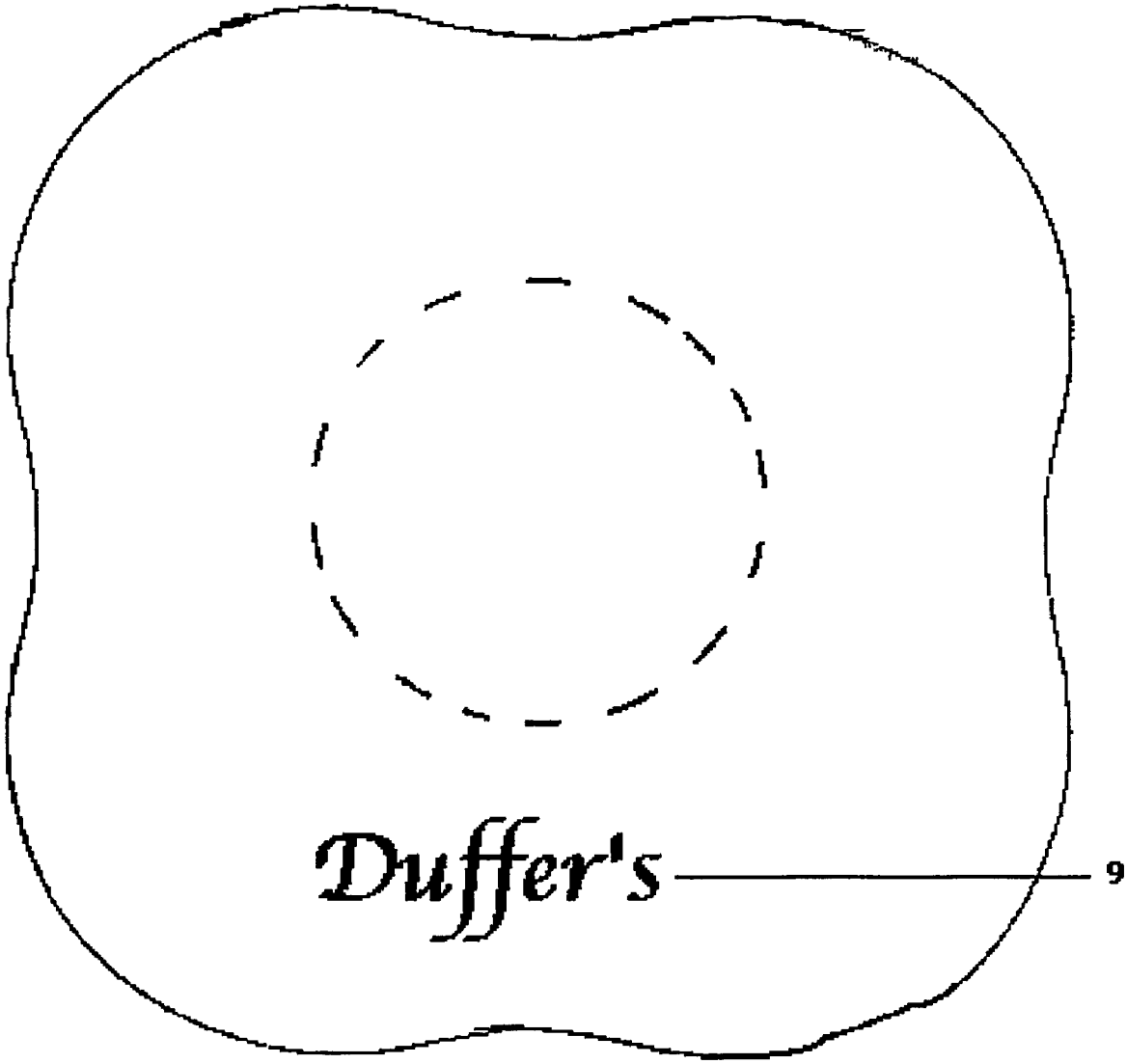
FIG. 11 shows a top view of another embodiment of the indicator, with lettering found on the body of the indicator.

As seen in FIG. 10, a ring 8 defining a hole 8*a* through the body 1 may be placed on the indicator to allow for hanging the indicator from a key chain, belt clip, a peg on a golf cart or other storage area. This ring 8 is manufactured from either plastic or metal. Additionally, to allow for advertising, suggestion of a player's or club's personal ownership of the indicator, etc., markings 9 such as lettering, numerals, or graphics such as logos can be provided on the body 1 of the indicator, as depicted in FIG. 11.

While this is the exemplary design expressed herein, other golf equipment designers and manufacturers may design similar ball indicators with slightly different dimensions or designs which the apparatus described herein may be easily resized to fit. Thus, while the present invention has been described in connection with exemplary embodiments thereof, it will be understood that many modifications in both design and use will be apparent to those of ordinary skill in the art, and this application is intended to cover any adaptations or variations thereof. It is therefore manifestly intended that this invention be limited only by the claims and the equivalents thereof.

The invention to be claimed is:

1. An apparatus for readily indicating the position of a played golf ball on the field of play, comprising:

a body manufactured from fabric having top and bottom surfaces and an outer edge; and an elasticized collar, said elasticized collar secured to the fabric body such that a pocket accessible through an opening is formed on said body, an object consisting of a golf ball, said opening having a first opening size and a second opening size, said second opening size larger than said first opening size, said second opening size achieved when an operator using a stretching means stretches said elasticized collar, said second opening size at least sufficiently sized to permit insertion of said object into said pocket, said opening closing down in size towards said first opening size when the stretching means is removed, whereby the size of the pocket opening is sufficiently reduced such that the object is retained completely within said pocket such that the object cannot accidentally be dislodged, and whereby the object can be removed from the pocket only by increasing the size of said opening towards said second opening size, to a size sufficient to allow the object's removal.

2. The apparatus of claim 1, wherein the fabric of the body is nylon.

3. The apparatus of claim 1, wherein the elasticized collar is sewn into the body.

4. The apparatus of claim 1, wherein the elasticized collar is externally affixed to the body, said collar thereby looping around the golf ball or object.

5. The apparatus of claim 1, wherein the circular pocket is sewn tightly closed along said body of the apparatus at said circular pocket's outer edge.

6. The apparatus of claim 1, wherein the outer edge of the body is oversewn along the perimeter or outermost circumference of the body to form a pocket.

7. The apparatus of claim 6, further comprising a plurality of weights to be sewn into the pocket.

8. The apparatus of claim 6, further comprising a single weighting means running continuously along the perimeter or outermost circumference of the body to be sewn into the pocket.

9. The apparatus of claim 1, further comprising a ring to be sewn into the body of the apparatus, said ring defining a hole in the body of the apparatus.

10. The apparatus of claim 9, wherein said ring is manufactured from metal.

11. The apparatus of claim 9, wherein said ring is manufactured from plastic.

12. The apparatus of claim 1, further comprising markings placed on the top surface of the body of the apparatus, said markings chosen from the group consisting of letters, numerals, or graphics.

* * * * *